US008167481B2

(12) United States Patent
Takeuchi et al.

(10) Patent No.: US 8,167,481 B2
(45) Date of Patent: May 1, 2012

(54) TIMEPIECE WHEEL TRAIN AND TIMEPIECE

(75) Inventors: Masao Takeuchi, Azumino (JP); Masami Murai, Shiojiri (JP); Shigeaki Seki, Matsumoto (JP); Tomokazu Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 158 days.

(21) Appl. No.: 12/753,380

(22) Filed: Apr. 2, 2010

(65) Prior Publication Data

US 2010/0254230 A1 Oct. 7, 2010

(30) Foreign Application Priority Data

Apr. 6, 2009 (JP) ..... 2009-091844
Jan. 26, 2010 (JP) ..... 2010-014306
Mar. 3, 2010 (JP) ..... 2010-046440

(51) Int. Cl.
*G04B 19/02* (2006.01)
*G04B 29/00* (2006.01)

(52) U.S. Cl. ..... 368/324; 368/220

(58) Field of Classification Search ..... 368/220, 368/324

See application file for complete search history.

(56) References Cited

U.S. PATENT DOCUMENTS

| | | | | |
|---|---|---|---|---|
| 6,472,062 | B1 * | 10/2002 | Neerinck et al. | 428/336 |
| 6,755,566 | B2 * | 6/2004 | Damasko | 368/127 |
| 7,234,541 | B2 * | 6/2007 | Scott et al. | 175/57 |
| 7,726,872 | B2 * | 6/2010 | Levingston | 368/175 |
| 2011/0044141 | A1 * | 2/2011 | Greubel et al. | 368/324 |

FOREIGN PATENT DOCUMENTS

| | | |
|---|---|---|
| JP | 11-133162 | 5/1999 |
| JP | 2003-222135 | 8/2003 |

* cited by examiner

*Primary Examiner* — Sean Kayes
(74) *Attorney, Agent, or Firm* — Mark P. Watson

(57) ABSTRACT

A timepiece wheel train includes a rotating body with a shaft unit, a bearing unit that rotatably supports the shaft unit of the rotating body, and a lubricating oil in which powder from a diamond-like carbon film is dispersed disposed between the shaft unit and the bearing unit.

7 Claims, 12 Drawing Sheets

| | CENTER WHEEL | THIRD WHEEL | FOURTH WHEEL | FIFTH WHEEL | SIXTH WHEEL | ROTOR |
|---|---|---|---|---|---|---|
| TOP PIVOT | 100 | 30 | 100 | 100 | 10 | 5 |
| BOTTOM PIVOT | | 500 | | 100 | 10 | 5 |

(MPa)

TIMEPIECE WHEEL TRAIN AND TIMEPIECE

CROSS-REFERENCE TO RELATED APPLICATIONS

Japanese Patent application Nos. 2009-091844, 2010-014306 and 2010-046440 are each incorporated by reference herein in its entirety.

BACKGROUND

1. Field of Invention

The present invention relates to a timepiece wheel train for driving the hands of a timepiece, and to a timepiece having this timepiece wheel train.

2. Description of Related Art

Wear between shaft parts and bearing units normally occurs in a timepiece wheel train that drives the hands of a timepiece due to the high side pressure applied to the shaft parts of each wheel, and this wear can lead to a variety of problems, including increased drive resistance caused by wear particles produced by this wear and deterioration of the lubricating oil, a shorter timepiece service life, and a loss of precision in the timepiece movement. Addressing this issue, Japanese Unexamined Patent Appl. Pub. JP-A-H11-133162 teaches a configuration that lowers wear between sliding parts.

The analog timepiece taught in JP-A-H11-133162 has a diamond-like carbon (DLC) film rendered on the rotating shaft support member in a configuration that supports the metal rotating shaft of a rotor by means of a rotating shaft support member, and thus uses a configuration that reduces wear between the rotating shaft and the rotating shaft support member without using lubricating oil.

While JP-A-H11-133162 teaches a configuration that uses only a DLC film to enable sliding with low resistance without using lubricating oil, this configuration cannot efficiently lower resistance in the timepiece wheel train of a mechanical timepiece because of the high side pressure, and resistance increases due to wear particles from the shaft members.

SUMMARY OF INVENTION

A timepiece and a timepiece wheel train according to the present invention can effectively reduce sliding resistance between a shaft unit and a bearing unit.

A first aspect of the invention is a timepiece wheel train including a rotating body with a shaft unit, a bearing unit that rotatably supports the shaft unit of the rotating body, and a lubricating oil in which powder from a diamond-like carbon film is dispersed disposed between the shaft unit and the bearing unit.

The timepiece wheel train of the invention includes the shaft unit of a rotating body such as a wheel and a bearing unit that rotatably supports the shaft unit, and has a lubricating oil in which powder from a diamond-like carbon (DLC) film is dispersed disposed between the shaft unit and the bearing unit. This powder is produced by rotational wear of the shaft unit on which the DLC film is formed, or is previously dispersed in the lubricating oil.

Such DLC powder has a low coefficient of friction and acts as a lubricating agent. In addition, because the DLC powder is dispersed in the lubricating oil, it can uniformly reduce sliding friction resistance throughout the area where the shaft unit and bearing unit slide in contact with each other. Furthermore, by using lubricating oil, wear particles that are produced do not accumulate in other parts of the wheel train, and the DLC powder can continue to reduce sliding resistance.

In the timepiece wheel train according to another aspect of the invention a diamond-like carbon film is formed on at least one of the shaft unit and the bearing unit, and the powder of the diamond-like carbon film dispersed in the lubricating oil consists of wear particles of the diamond-like carbon film that are produced when the diamond-like carbon film formed on at least one of the shaft unit and the bearing unit wears during rotation of the shaft unit.

In this aspect of the invention particles from the DLC film are produced and dispersed in the lubricating oil as a result of the shaft unit rotating and the DLC film wearing due to sliding contact with the bearing unit, and act as a lubricating agent, and the DLC film powder can reduce frictional resistance between the shaft unit and the bearing unit. It is therefore not necessary for DLC wear particles to be initially dispersed in the lubricating oil. Even when the lubricating oil does not initially contain DLC powder, the lubricating oil and DLC film reduce initial sliding friction resistance, and when the DLC film wears over time as a result of rotation of the shaft unit, wear particles from the DLC film act as a lubricating agent by being dispersed in the lubricating oil.

In the timepiece wheel train according to another aspect of the invention a diamond-like carbon film is formed on at least one of the shaft unit and the bearing unit.

In this aspect of the invention a diamond-like carbon film is formed on at least one of the shaft unit and the bearing unit, and lubricating oil or lubricating oil containing a DLC powder dispersion is placed between the shaft unit and the bearing unit.

The DLC film alone can initially reduce sliding friction resistance uniformly throughout the area where the shaft unit and bearing unit slide together because of its low friction and low wear effect. When the shaft unit then rotates and the DLC film wears due to sliding, the resulting powder from the DLC film has a low coefficient of friction and acts as a lubricating agent. Because lubricating oil is between the shaft unit and the bearing unit at this time, the DLC film powder is dispersed into the lubricating oil, and can uniformly reduce sliding friction resistance throughout the area where the shaft unit and bearing unit slide against each other.

In a timepiece wheel train according to another aspect of the invention the diamond-like carbon film is formed by physical vapor deposition.

In this aspect of the invention the diamond-like carbon film is formed by physical vapor deposition. With chemical vapor deposition (CVD) methods whereby a film is deposited on the surface of the shaft unit or bearing unit by a chemical reaction, sufficient hardness of 20 GPa or more cannot be achieved in the resulting DLC film on the shaft portions of precision parts such as timepiece components, and adhesion to the shaft unit or bearing unit is not sufficient. With ion plating or other physical vapor deposition (PVD) method whereby the shaft unit or bearing unit is bombarded with ionized DLC film molecules, however, a DLC film with high hardness of 20 GPa to 40 GPa can be reliably formed with good adhesion on the shaft unit or bearing unit of precision parts such as timepiece components. By thus forming a high hardness DLC film with good adhesion on either the shaft unit or the bearing unit, exfoliation of the DLC film when the shaft unit rotates can be prevented, the particle diameter of wear particles produced by wear is small, and the wear particles can be made to function as a good lubricating agent. Sliding friction can therefore be further reduced between the shaft unit and bearing unit of the wheel train where high side pressure is applied.

In a timepiece wheel train according to another aspect of the invention the diamond-like carbon film is formed by physical vapor deposition in a hydrogen-free atmosphere.

This aspect of the invention creates a hydrogen-free DLC film using a PVD process in a hydrogen-free atmosphere, that is, a hydrogen-free PVD process. If hydrogen is introduced when the DLC film is formed by a PVD method, the ratio of graphitic $sp^2$ bonds to cubic diamond $sp^3$ bonds increases, and a DLC film with both sufficiently high adhesion and high hardness cannot be achieved. However, by depositing a hydrogen-free DLC film using a hydrogen-free PVD method, this aspect of the invention increases the ratio of $sp^3$ bonds in the crystal structure of the DLC film, and can thus form a DLC film with higher hardness and high adhesion.

In a timepiece wheel train according to another aspect of the invention a diamond-like carbon film is formed on either the shaft unit or the bearing unit, and the other of the shaft unit or bearing unit on which the diamond-like carbon film is not formed is made from a hard material with lower hardness than the diamond-like carbon film.

In this aspect of the invention the hardness of the component on which the DLC film is not formed is less than or equal to the hardness of the DLC film. For example, if the DLC film formed with a hardness of 20 GPa on the shaft unit, the bearing unit is made from a hard material with hardness comparable to or less than the hardness of the DLC film, such as ruby with a hardness of 15 GPa. By using such a hard material, wear of the hard material can be suppressed and a low friction effect can be maintained when sliding against the DLC film because the hardness is sufficiently high and sliding friction resistance with the DLC film is low. In addition, because the hardness is lower than the hardness of the DLC film, the DLC film is not worn excessively by the hard material, and sliding friction resistance can be reduced with good balance by means of the low friction effect of the DLC film and the low friction effect of the DLC film powder in the lubricating oil.

Further preferably in this aspect of the invention, an intermetallic layer is formed on the surface of the shaft unit or bearing unit on which the diamond-like carbon film is formed, and the diamond-like carbon film is formed on this intermetallic layer.

By forming an intermetallic layer on the base material of the shaft unit or bearing unit and forming the DLC film on this intermetallic layer, the intermetallic layer can absorb the stress difference of the base material and the DLC film, and DLC film adhesion can be improved. By thus forming a DLC film with high adhesion strength on one member that slides against a companion part (the member on which the DLC film is not formed, either the shaft unit or the bearing unit) having lower hardness than the DLC film, the particle diameter of the wear particles of the DLC film produced by friction is less than or equal to 100 nm. When the DLC film wear particles have a diameter of 100 nm or less, the wear particles of the DLC film do not collect in one place, are desirably dispersed in the lubricating oil, and can uniformly reduce frictional resistance between the shaft unit and bearing unit.

In a timepiece wheel train according to another aspect of the invention an oil and diamond-like carbon powder retention layer that suppresses spreading of the lubricating oil and retains powder from the diamond-like carbon film is formed on at least one of the shaft unit and bearing unit.

Because an oil and diamond-like carbon powder retention layer is formed on the shaft unit and bearing unit in this aspect of the invention, the lubricating oil is not sprayed away from the shaft unit and bearing unit and can be desirably held for a long time between the shaft unit and the bearing unit. Powder from the DLC film between the shaft unit and bearing unit is thus dispersed in the lubricating oil held between the shaft unit and bearing unit, problems such as the powder flying off onto other members or building up in one place can be avoided, and the friction resistance between the shaft unit and bearing unit can be further reduced by the DLC powder being held in the lubricating oil for a long time.

Further preferably in another aspect of the invention, the oil and diamond-like carbon powder retention layer is formed by applying a fluoroplastic coating.

In this aspect of the invention the oil and diamond-like carbon powder retention layer is formed by means of a fluoroplastic coating.

With this type of fluoroplastic material the oil and diamond-like carbon powder retention layer can be more easily formed by simply coating the surface, and the oil and diamond-like carbon powder retention effect can be desirably maintained when the shaft unit rotates. In addition, if the DLC film exfoliates, the fluoroplastic in the oil and diamond-like carbon powder retention layer is refreshed on the exfoliated surface, and the oil and diamond-like carbon powder retention effect can be maintained for a long time.

In addition, the fluoroplastic coating can also be expected to further reduce the frictional resistance of the shaft unit by acting as a solid lubricating agent due to the low friction effect of fluorine.

In a timepiece wheel train according to another aspect of the invention the particle diameter of powder from the diamond-like carbon film is less than or equal to 100 nm.

In this aspect of the invention the powder of the DLC film includes both DLC film powder that is produced by friction between the shaft unit and bearing unit and dispersed in the lubricating oil, and DLC film powder that is previously dispersed in the lubricating oil.

The particle diameter of DLC film powder is less than or equal to 100 nm in the invention, and is sufficiently small. As a result, such DLC film powder can be desirably dispersed in the lubricating oil, and such problems as the DLC film powder collecting in one place can be avoided. Furthermore, because DLC film powder with such a small particle diameter is dispersed in the lubricating oil, frictional resistance can be uniformly reduced for the shaft unit and bearing unit, and an even better lubrication effect can be achieved.

Another aspect of the invention is a timepiece including a wheel train including a rotating body with a shaft unit, and a bearing unit that rotatably supports the shaft unit of the rotating body; hands that are driven by the wheel train; and a lubricating oil in which powder from a diamond-like carbon film is dispersed disposed between the shaft unit and the bearing unit.

This aspect of the invention can increase timepiece life because sliding friction resistance between shaft and bearing units can be reduced for a long time as described above.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

Figure 1:
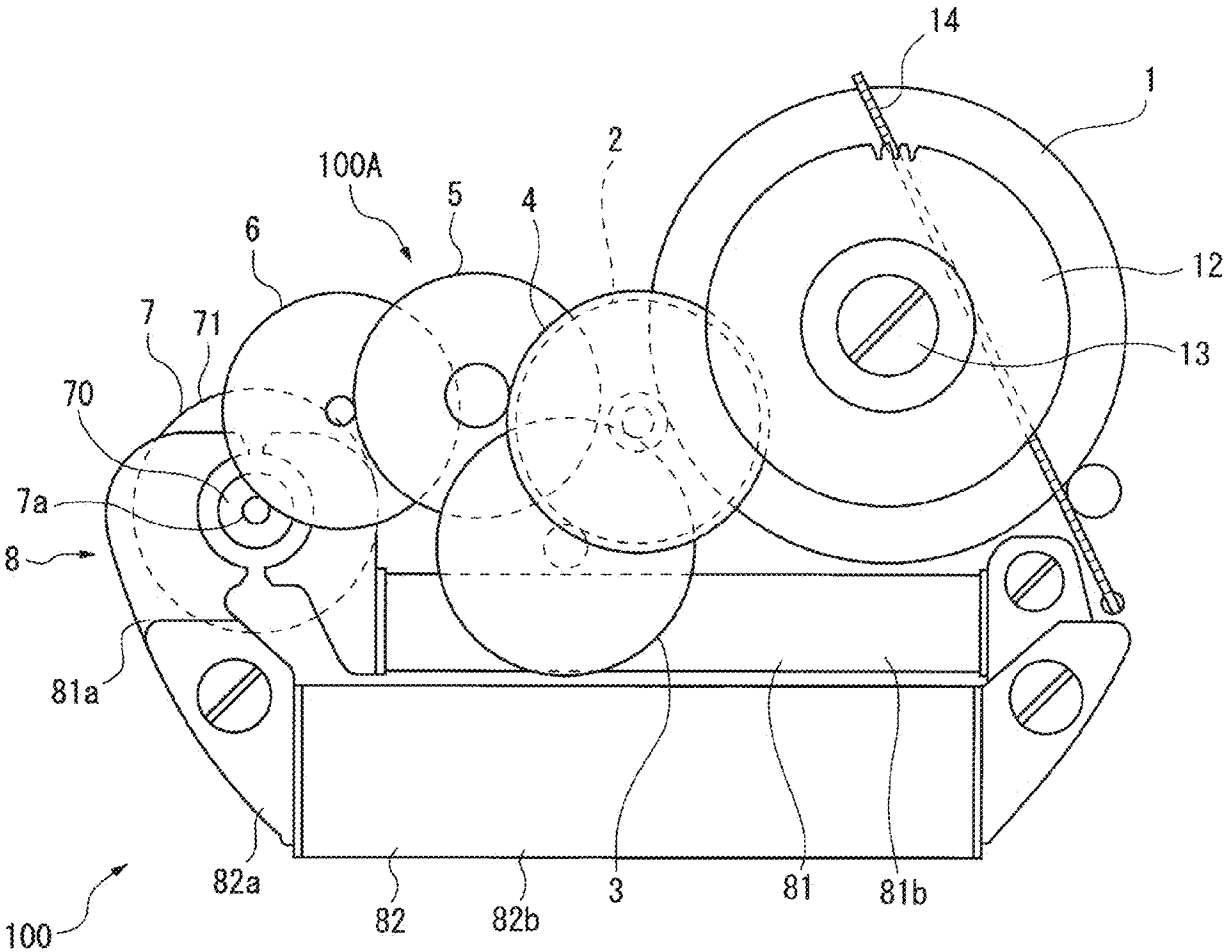
FIG. 1 is a schematic plan view of an electronically controlled mechanical timepiece having a timepiece wheel train according to the invention.
Figure 2:
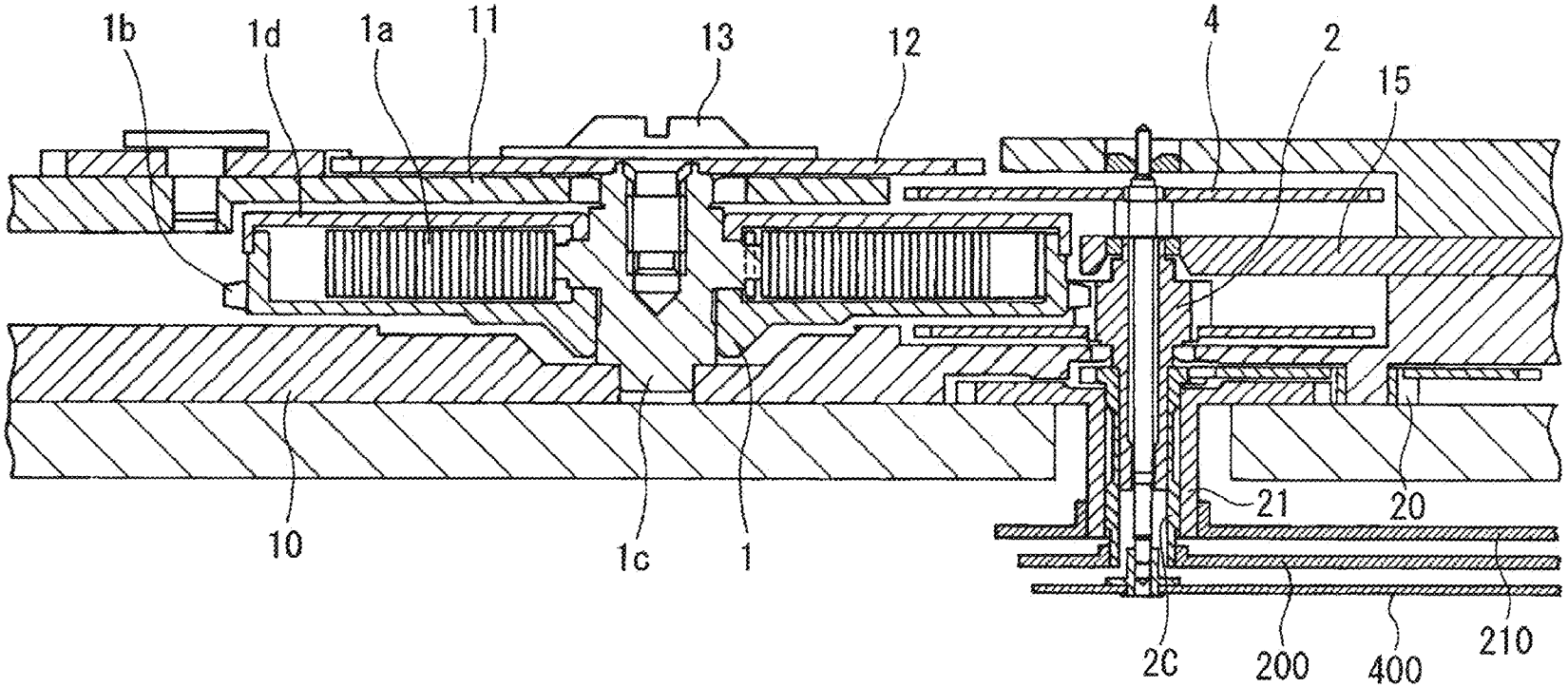
FIG. 2 is a section view showing main parts of an electronically controlled mechanical timepiece according to a preferred embodiment of the invention.
Figure 3:
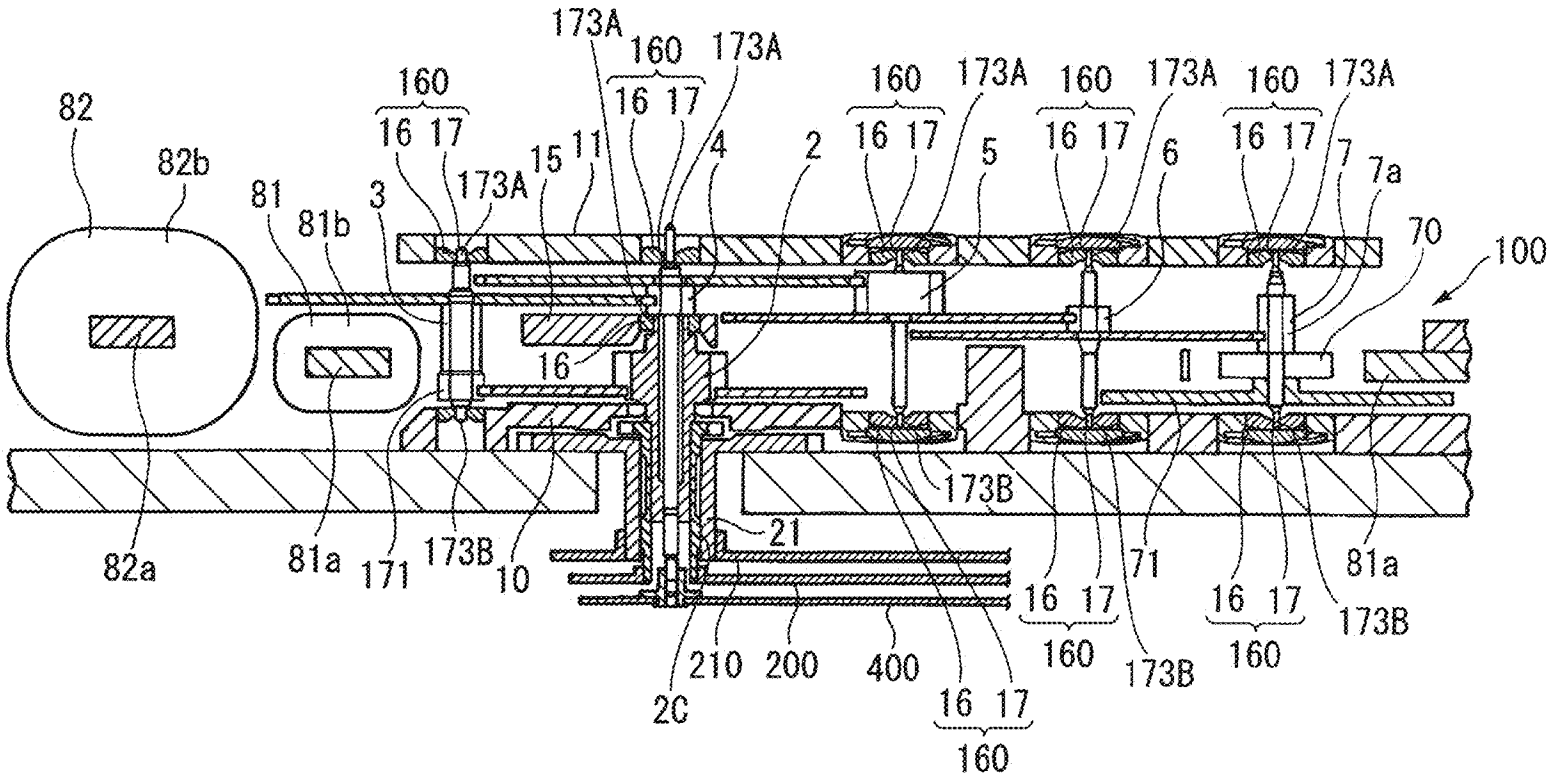
FIG. 3 is another section view showing main parts of an electronically controlled mechanical timepiece according to a preferred embodiment of the invention.

FIG. 1 is a plan view showing some of the main parts of an electronically controlled mechanical timepiece (timepiece) having a timepiece wheel train according to the invention, and FIG. 2 and FIG. 3 are section views of the timepiece shown in FIG. 1.

The electronically controlled mechanical timepiece 100 (referred to as simply a timepiece below) according to this embodiment of the invention has a movement barrel 1 including a mainspring 1*a* as a mechanical energy source, a barrel wheel 1*b*, a barrel arbor 1*c*, and a barrel cover 1*d*. The outside end of the mainspring 1*a* is attached to the barrel wheel 1*b*, and the inside end is attached to the barrel arbor 1*c*. The barrel arbor 1*c* is supported by the main plate 10 and train wheel bridge 11, and is fastened by a ratchet wheel screw 13 to rotate in unison with a ratchet wheel 12.

The ratchet wheel 12 is engaged by a click 14 (see FIG. 1) so that the ratchet wheel 12 can rotate clockwise but not counterclockwise. Note that the method of rotating the ratchet wheel 12 clockwise and winding the mainspring 1*a* is the same as with the automatic or manual winding mechanism of a mechanical wristwatch known from the literature, and further description thereof is thus omitted.

Note, further, that a mainspring 1*a* is used as a source of mechanical energy in this embodiment of the invention, but the invention is not so limited. For example, a stepping motor that is driven by electric power supplied from a battery may be used as a mechanical energy source, or another type of mechanical energy source may be used instead.

In this embodiment of the invention rotation of the barrel wheel 1*b* is accelerated and transmitted to a rotor 7 through a timepiece wheel train 100A including a center wheel 2, third wheel 3, fourth wheel 4, fifth wheel 5, and sixth wheel 6. More specifically, rotation of the barrel wheel 1*b* is accelerated seven times and transmitted to the center wheel 2, accelerated 6.4 times from the center wheel 2 to the third wheel 3, accelerated 9.375 times from the third wheel 3 to the fourth wheel 4, accelerated 3 times from the fourth wheel 4 to the fifth wheel 5, accelerated 10 times from the fifth wheel 5 to the sixth wheel 6, and accelerated 10 times from the sixth wheel 6 to the rotor 7 of the power generator, and is thus accelerated a total 126,000 times while being transmitted to the rotor 7.

A cannon pinion 2*c* is affixed to the center wheel 2 of the timepiece wheel train 100A, a minute hand 200 is affixed to the cannon pinion 2*c*, a hour hand 210 is affixed to the hour wheel 21 that is driven by the 2*c* through the minute wheel 20, and a second hand 400 is affixed to the fourth wheel 4. Therefore, in order to drive the center wheel 2 at 1 rph and the fourth wheel 4 at 1 rpm, the rotor may be driven at 8 rps, at which time the movement barrel turns at 1/7 rph.

The generator 8 of this timepiece 100 also functions as a regulator, and includes the rotor 7, a stator 81, and a coil block 82.

The rotor 7 includes a rotor magnet 70, a rotor pinion 7*a*, and a rotor inertia plate 71. The rotor inertia plate 71 is used to reduce variation in the rotational speed of the rotor 7 due to changes in the drive torque from the movement barrel 1.

The stator 81 has a stator coil 81*b* wound 40,000 turns, for example, around a stator core 81*a*. The coil block 82 has a coil 82*b* wound 110,000 times around a magnetic core 82*a*. The coil 82*b* is configured to detect rotation of the rotor 7 by detecting variation in the output voltage. This coil 82*b* and the stator coil 81*b* are connected in series so that the output voltage is the sum of the voltage produced by each. The stator core 81*a* and magnetic core 82*a* are made from Permalloy C, for example.

Figure 4:
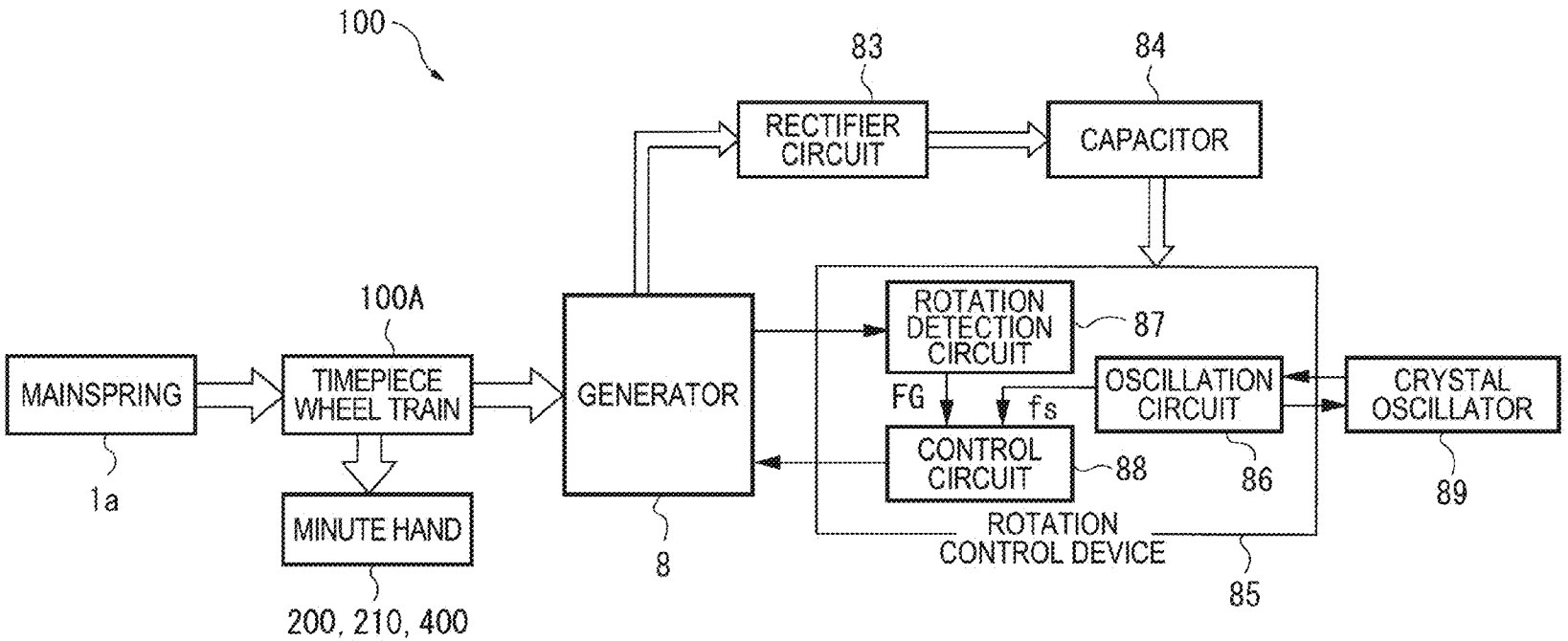
FIG. 4 is a block diagram showing the configuration of an electronically controlled mechanical timepiece according to a preferred embodiment of the invention.

FIG. 4 is a block diagram showing the configuration of the timepiece 100 in this embodiment of the invention.

The timepiece 100 has a mainspring 1*a* as described above, a timepiece wheel train 100A that accelerates and transmits rotation of the mainspring 1*a* to the generator 8, and hands 200, 210, and 400 that are coupled to the timepiece wheel train 100A and display the time.

The generator 8 is driven by the mainspring 1*a* through the timepiece wheel train 100A, produces inductive power, and supplies electrical energy. The AC output from the generator 8 is boosted and rectified through a rectifier circuit 83, and is supplied and stored in a capacitor 84.

A rotation control device 85 rendered by a single-chip semiconductor device is driven by power supplied from the capacitor 84. This rotation control device 85 includes an oscillation circuit 86, rotation detection circuit 87 for detecting rotation of the rotor 7, and a brake control circuit 88.

The oscillation circuit 86 outputs an oscillation signal (32,768 Hz) using a crystal oscillator 89 as a reference time source, frequency divides this oscillation signal by means of a specific frequency division circuit, and outputs the result as reference signal fs to the brake control circuit 88.

The rotation detection circuit 87 detects the speed of rotor 7 rotation from the waveform of the power output from the generator 8, and outputs the rotation detection signal FG to the brake control circuit 88.

The control circuit 88 inputs a brake signal to and regulates the generator 8 (regulator) based, for example, on the phase difference of the rotation detection signal FG to the reference signal fs. As a result, rotation of the movement barrel 1 containing the mainspring 1*a* is controlled by the rotation control device 85, the generator 8, and the timepiece wheel train 100A, and mechanical energy stored in the mainspring 1*a* is released. In this embodiment of the invention the regulator mechanism includes the rotation control device 85, the generator 8, the timepiece wheel train 100A, and the movement barrel 1.

As shown in FIG. 3, bearing units 16 made of ruby and thus also functioning as decorative elements are press fit into the main plate 10, train wheel bridge 11, and center wheel bridge 15, and the pivots 173A and 173B of wheels 2 to 6 and the rotor 7 are supported by the bearing units 16. More specifically, wheels 2 to 6 and the rotor 7 are supported by a sliding shaft receiving device 160 including a staff 17 and a bearing unit 16.

The bearing unit 16 is a member made from a high hardness material with a hardness rating of 10 GPa to 30 GPa, and in this embodiment of the invention ruby having a 10 GPa hardness rating compared with the 20 GPa hardness of a DLC film is used. Note that the bearing units 16 are not limited to ruby, and other types of rare minerals with sufficient wear resistance and hardness in the foregoing range may be used. An anti-shock configuration known from the literature is also applied to the sliding shaft receiving devices 160 of the fifth wheel 5, the sixth wheel 6, and the rotor 7, and further description thereof is thus omitted.

Figures 5, 6:
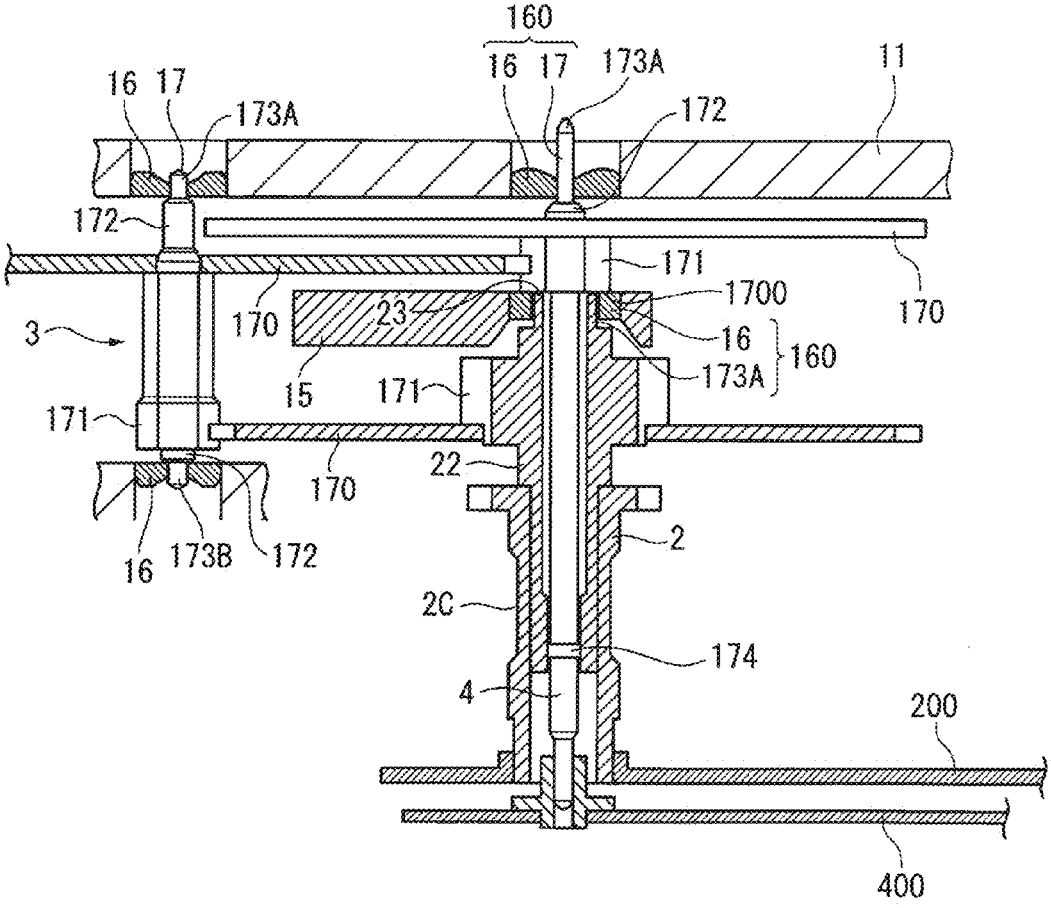
FIG. 5 is a table showing the side pressure associated with the wheels of the timepiece wheel train in a preferred embodiment of the invention.
FIG. 6 is a section view showing main parts of the second wheel, third wheel, and fourth wheel.

As described above, the side pressure on the bottom pivot 173B of the third wheel 3 is much higher than the surface pressure on the pivots 173A and 173B of the other wheels 2 and 4 to 6 in the timepiece 100 according to this embodiment of the invention. FIG. 5 shows the side pressure on the wheels 2 to 6. As shown in FIG. 5, the bottom pivot 173B of the third wheel 3 receives greater side pressure than the pivots 173A and 173B of the other wheels 2 and 4 to 6. As a result, this third wheel 3 wears extremely easily, and as wear progresses this wear can reduce the precision of the movement and regularly require overhauling. The pinion of the third wheel 3 to which torque is transmitted is also subject to great force as a result of meshing with the wheel of the center wheel 2, and can also contribute to a loss of precision in the movement during long-term use.

Figure 7:
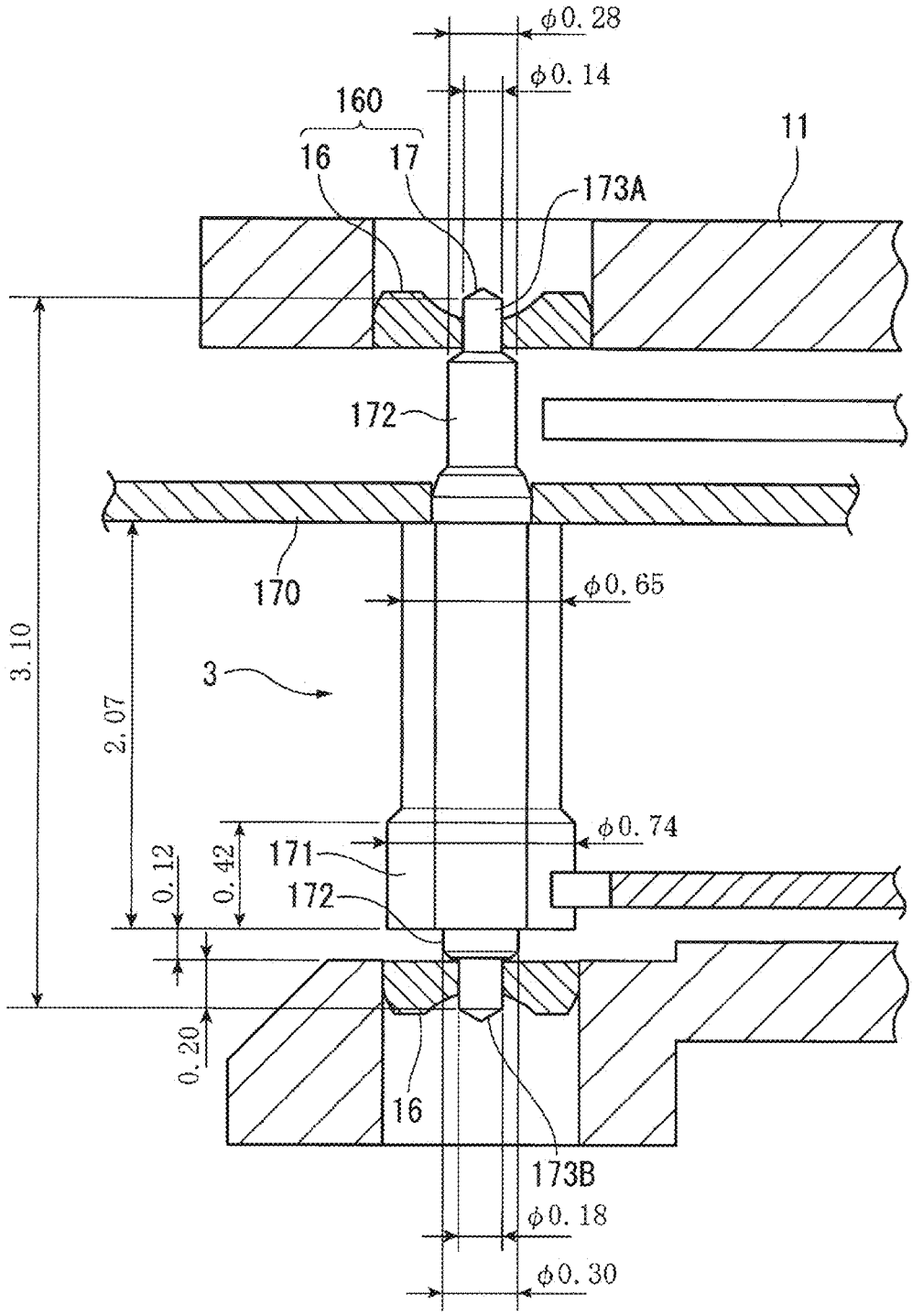
FIG. 7 is an enlarged view of the parts near the third wheel in FIG. 6.

FIG. 6 is a section view showing the main parts of the center wheel 2, third wheel 3, and fourth wheel 4. FIG. 7 is an enlarged view of the third wheel 3 and surroundings in FIG. 6.

In this embodiment of the invention a DLC (diamond-like carbon) film is formed on the bottom pivot 173B of the third wheel 3 where the side pressure is greatest, thereby improving wear resistance and reducing friction.

Disposed to the staff 17 of the third wheel 3 are, from top to bottom in FIG. 6 and FIG. 7, a top pivot 173A, a top play limiting part 172, wheel 170, pinion 171, a bottom play limiting part 172, and the bottom pivot 173B. A gap (play) is provided between the play limiting part 172 and the bearing unit 16, and when the third wheel 3 is subject to shock in the axial direction, the third wheel 3 can move axially in this gap so that the shock can be absorbed.

The third wheel 3 is a precision part, and the actual dimensions of the various parts of the third wheel 3 in this embodiment of the invention are shown in FIG. 7. More specifically, the diameter of the top pivot 173A is 0.14 mm, the diameter of the top play limiting part 172 is 0.28 mm, the diameter of the middle part of the staff is 0.65 mm, the diameter of the pinion 171 is 0.74 mm, the diameter of the bottom play limiting part 172 is 0.30 mm, and the diameter of the bottom pivot 173B is 0.18 movement. The overall length of the third wheel 3 staff 17 in the axial direction is 3.10 mm, the combined length of the middle part of the staff and the pinion 171 is 2.07 mm, the length of the pinion 171 is 0.42 mm, the length of the bottom play limiting part 172 is 0.12 mm, and the length of the bottom pivot 173B is 0.20 mm. The DLC film is formed on the bottom pivot 173B (0.18 mm diameter, 0.20 mm long).

Note that the area where the DLC film is formed is not limited to the bottom pivot 173B of the third wheel 3. For example, a DLC film may also be rendered on the top pivot 173A that slides against the bearing unit 16. Yet further, a DLC film may be formed only on the parts such as wheels that slide against other parts.

The configurations of the fifth wheel 5 and sixth wheel 6 in this embodiment of the invention are identical to the third wheel 3, and further description thereof is omitted.

A guide spacer 174 is disposed near the bottom end (the bottom as seen in FIG. 6) of the staff 17 of the fourth wheel 4, and the second hand 400 is attached to the bottom end of the staff 17. This guide spacer 174 is a bearing unit that contacts the inside circumference surface of the pipe 22 of the center wheel 2, and prevents the center wheel 2 and fourth wheel 4 from rotating eccentrically due to the weight of the hands 200 and 400, for example. Note that a play limiting part 172 identical to that of the third wheel 3 is disposed to the top end of the staff 17.

The center wheel 2 is configured with the staff 17 of the fourth wheel 4 inserted to the pipe 22 to which the wheel 170 and pinion 171 are affixed, and the cannon pinion 2*c*, to which the minute hand 200 is attached, attached to the pipe 22. The top end (the top as seen in FIG. 6) of the pipe 22 is the small diameter top pivot 173A, which is inserted to the bearing unit 16. The top end of the top pivot 173A is a sliding part 23 that contacts the fourth wheel 4.

Third Wheel Bearing Configuration

The configuration of the bearing for the third wheel 3 described above is described next. The DLC film rendered on the third wheel 3 is formed to a hardness of 20 GPa to 40 GPa, and has hardness comparable to or greater than that of ruby, which is a high hardness material used for the bearing unit 16 and has a hardness of 15 GPa in this embodiment of the invention. The DLC film therefore wears as a result of sliding contact with the bearing unit 16, but wear can be suitably suppressed compared with a configuration in which the film hardness is less than that of the bearing unit 16, and the DLC film is therefore retained on the staff 17 for a long time. In addition, because the DLC film has low friction resistance and does not aggressively wear the opposing surface (bearing unit 16), wear of the bearing unit 16 from sliding against the DLC film is also suppressed. Wear due to friction between the staff 17 and the bearing unit 16 can therefore be suppressed, and the precision of the movement of the timepiece 100 can be kept high for a long time.

More specifically, in this embodiment of the invention the base metal of the third wheel 3 staff 17 is carbon steel with a hardness of 3 to 8 GPa, and the surface of the carbon steel is coated with a Ni plating. A Ti layer is then sputtered onto the surface of the Ni plating as the base layer of the DLC film. The DLC film is formed on top of this Ti layer. By thus forming the DLC film on a Ti base layer, the stress difference between the carbon steel and the DLC film can be absorbed, and DLC film adhesion can be assured. Note that while a Ti layer is formed as the intermetallic layer of the invention in this embodiment of the invention, other embodiments may have a Cr layer or other type of metal layer rendered as the intermetallic layer instead.

A lubricating oil in which DLC film powder ("DLC powder" below) is dispersed is also provided between the staff 17 and the bearing unit 16 in this embodiment of the invention.

The invention can reduce sliding friction resistance between the staff 17 and the bearing unit 16 by dispersing DLC powder in the lubricating oil. To determine the effect of a lubricating oil containing a DLC powder dispersion in a timepiece 100 according to this embodiment of the invention, a timepiece durability test assuming long-term use of the timepiece 100 was conducted using wear particles from the DLC film as the powder dispersed in the lubricating oil as described below. This timepiece durability test is an accelerated durability test in which the timepiece wheel train is driven at a faster than normal rate, DLC film wear particles resulting from wear of the DLC film form on the staff 17, and the wear particles from the DLC film are dispersed as DLC powder in the lubricating oil. In a timepiece 100 according to this embodiment of the invention, a Ti layer is formed as a base layer on the base metal of the bottom pivot 173B (staff 17) after rendering a Ni plating over the carbon steel base, and the DLC film is formed over this Ti layer. When the hardness of the DLC film in this configuration is greater than the hardness of the bearing unit 16, the particle diameter of the largest wear particles of the DLC film resulting from the DLC film of the staff 17 and the bearing unit 16 sliding together is less than or equal to 100 nm.

Note that the method of dispersing DLC powder in the lubricating oil is not limited to the foregoing. For example, DLC powder may be produced and dispersed in the lubricating oil before the lubricating oil is placed between the staff 17 and the bearing unit 16.

Figure 8:
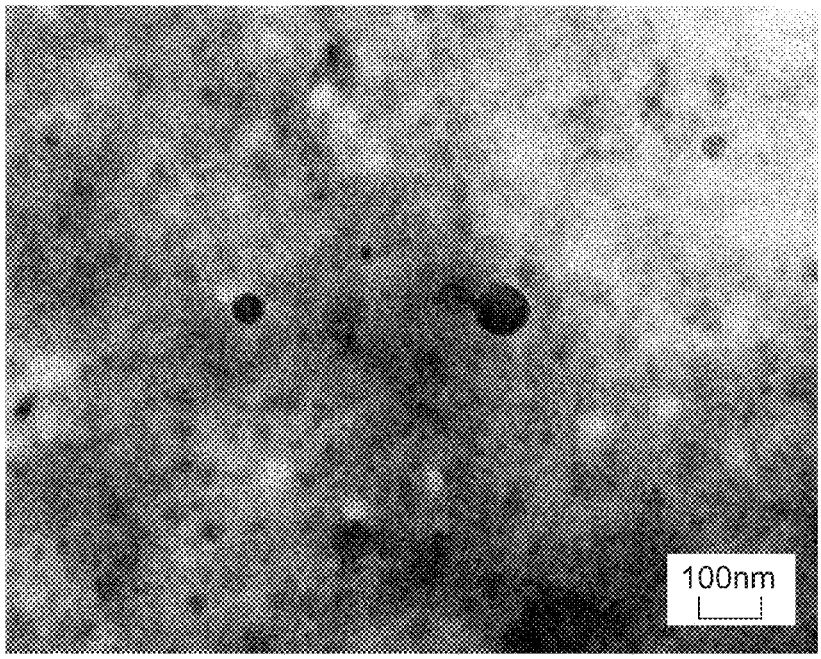
FIG. 8 is a photograph showing lubricating oil near the DLC film observed by transmission electron microscopy (TEM) after a timepiece durability test of a timepiece having a DLC film.

FIG. 8 is a photograph showing the lubricating oil around the DLC film when observed by a transmission electron microscope (TEM) after a timepiece durability test of a timepiece in which a 1.5 μm thick DLC film is formed on the bottom pivot 173B of the third wheel 3.

As shown in FIG. 8, only DLC powder with a diameter of 100 nm or less was observed in the lubricating oil with a timepiece 100 according to this embodiment of the invention. While production and dispersion of wear particles in the lubricating oil by wear between the DLC film and the bearing unit 16 was confirmed in this timepiece durability test, the particle diameter of the wear particles ranged from a nearly unobservable size to a maximum of approximately 100 nm. When the DLC powder is sufficiently fine and is present as a dispersion in the lubricating oil, the wear particles act as a good lubricant due to the low friction properties of DLC powder. The sliding friction resistance between the staff 17 and the bearing unit 16 can therefore be further reduced by the combined effects of the DLC film formed on the pivots 173A and 173B, the lubricating oil, and the DLC powder.

Figure 9:
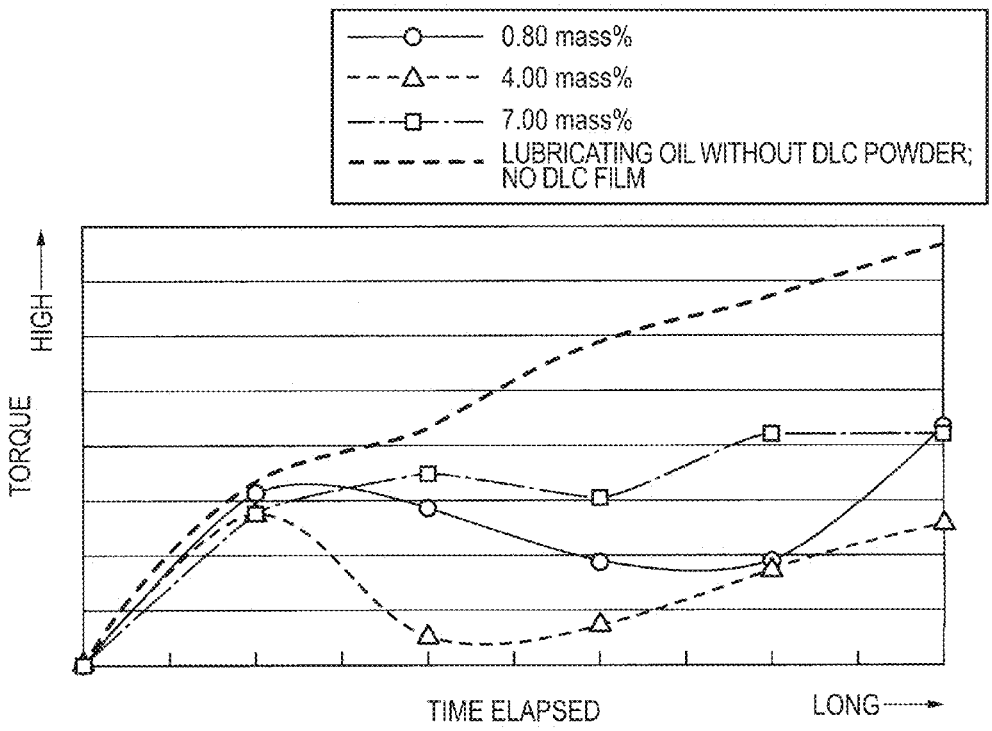
FIG. 9 shows the relationship between torque increase and the amount of DLC film particulate contained in the lubricating oil.

The torque of a third wheel 3 using a lubricating oil with a DLC powder dispersion, and the torque of a third wheel 3 using a lubricating oil without a DLC powder dispersion, are compared in FIG. 9. FIG. 9 shows the change in torque in a timepiece durability test using a third wheel in which the DLC powder content of the lubricating oil is 0.8 mass %, a third wheel in which the DLC powder content of the lubricating oil is 4.0 mass %, a third wheel in which the DLC powder content of the lubricating oil is 7.0 mass %, and a third wheel in which the lubricating oil does not contain DLC powder.

Referring to FIG. 9, a lubricating oil with a DLC powder content of 0.8 mass % can be obtained by forming a 0.1 μm thick DLC film on the staff 17 and wearing the DLC film down in a prescribed volume of lubricating oil. A lubricating oil with a DLC powder content of 4.0 mass % can be obtained by forming a 0.5 μm thick DLC film on the staff 17 and wearing this DLC film down, and a lubricating oil with a DLC powder content of 7.0 mass % can be obtained by forming a 0.8 μm thick DLC film on the staff 17 and wearing this DLC film down.

As shown in FIG. 9, increased torque is not observed as a result of increasing the DLC powder content of the lubricating oil, and the increase in torque over time is less than half the increase observed in the sample containing no DLC powder. The optimum film thickness of the DLC film in this embodiment of the invention is 1 μm as further described below, and when lubricating oil is injected between a staff 17 on which a DLC film is formed and the bearing unit 16, the DLC powder content in the lubricating oil was within the range of approximately 0.8 to 7.0 mass % after a one to ten year equivalent timepiece durability test (accelerated durability test).

Comparing samples in which DLC powder is dispersed in the lubricating oil between the staff 17 and bearing unit 16 with the sample in which DLC powder is not contained in the lubricating oil, it can be confirmed from FIG. 9 that when DLC powder is dispersed in the lubricating oil torque is lower when the staff 17 rotates than when DLC powder is not contained in the lubricating oil.

Furthermore, while not shown in the figure, the lubricating effect of the DLC powder can be confirmed even when the wear particle content in the lubricating oil is less than or equal to 0.8 mass %. In this situation, however, the DLC wear particles may not be dispersed where the DLC wear particles are needed depending upon the lubricating oil and the state of DLC film wear, and the combined frictional resistance reduction effect of the lubricating oil and the DLC powder dispersed in the lubricating oil may not be effectively achieved.

As a result, the amount of DLC powder contained in the lubricating oil is preferably 0.8 mass % to 7.0 mass %.

Deterioration of the lubricating oil is described next.

Figure 10A:
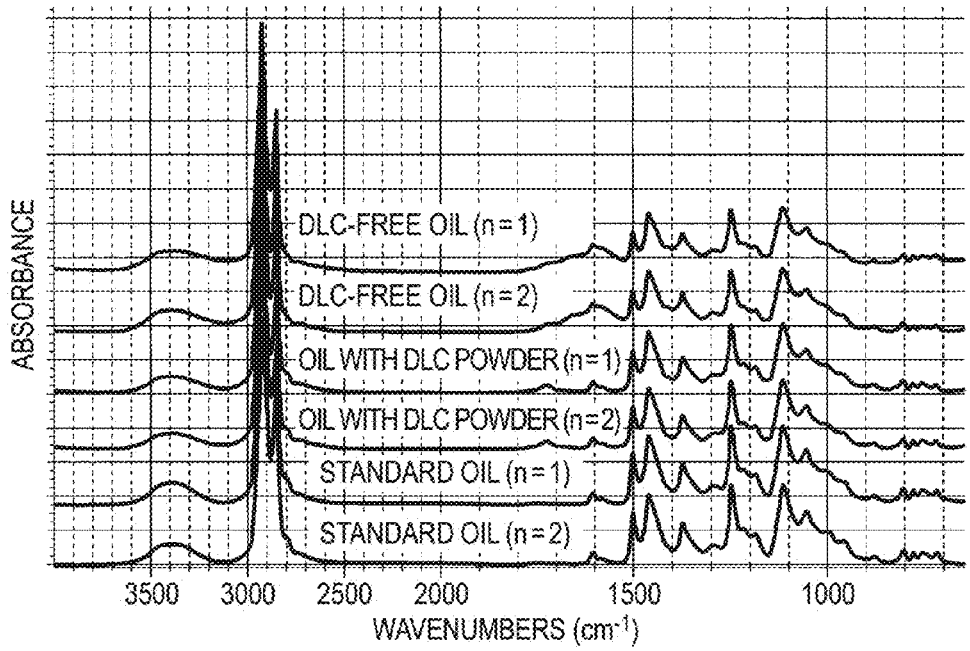
FIG. 10A shows the results of analysis by Fourier transform infrared spectroscopy (FTIR) of the lubricating oil used in the durability test.
Figure 10B:
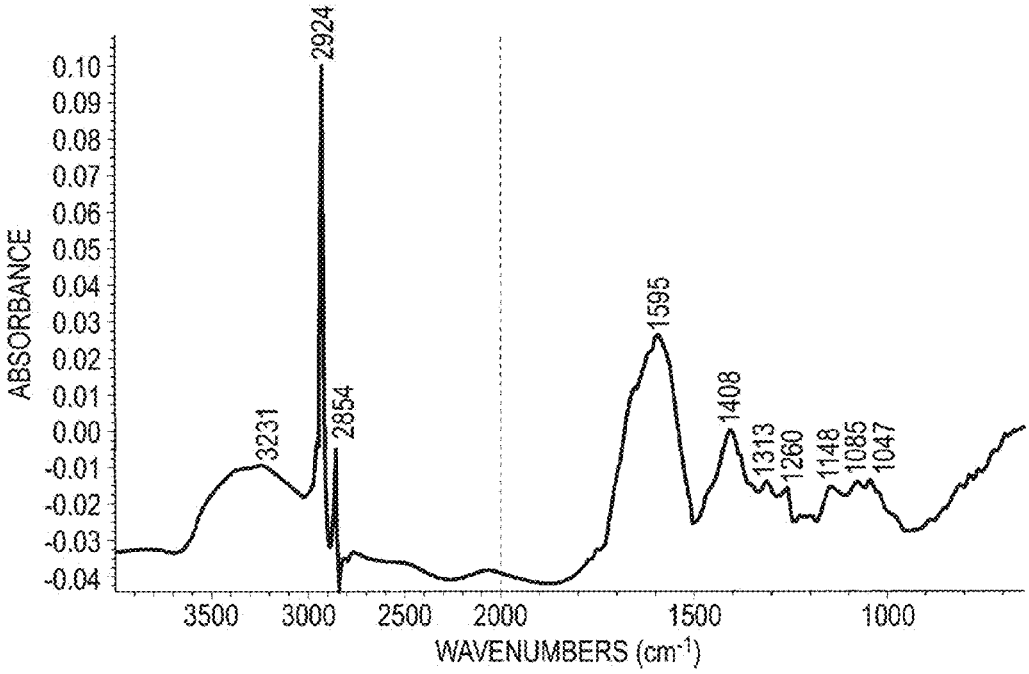
FIG. 10B shows the values obtained by subtracting the absorbance obtained by FTIR of the lubricating oil after the test is completed on a sample in which the DLC film is not formed from the absorbance obtained by FTIR of the lubricating oil after the test is completed on a sample in which the DLC film is formed.

FIG. 10A shows the results of FTIR (Fourier transform infrared spectroscopy) analysis of the lubricating oils used in the durability test, and FIG. 10B graphs the values obtained by subtracting the absorbance determined by FTIR analysis of the lubricating oil after the durability test using a sample not having a DLC film, from the absorbance determined by FTIR analysis of the lubricating oil after the durability test using a sample having a DLC film.

The following are known by comparing the deterioration of the lubricating oil after the timepiece durability test using a sample without a DLC film, the deterioration of the lubricating oil after the timepiece durability test using a sample with a DLC film, and the deterioration of the lubricating oil before the timepiece durability test, as shown in FIG. 10.

More specifically, as shown in FIG. 10B, compared with the lubricating oil when a DLC film is formed, a great difference in absorbance is observed between 2924 $cm^{-1}$ and 2854 $cm^{-1}$, and the range from 1850 $cm^{-1}$ to 1550 $cm^{-1}$ with the lubricating oil when the DLC film is not formed.

The difference in the range from 1850 $cm^{-1}$ to 1550 $cm^{-1}$ is attributable to mainly carboxylate structures and fused ring structures that are formed when a DLC film is not present. In addition, there is significant breakdown of aromatic rings that are contained in the lubricating oil and components that contain an aromatic ring in the lubricating oil when the DLC film is not present, and a difference occurs in the ratio of C—H bonds in the lubricating oil when the DLC film is present and the lubricating oil when the DLC film is not present. As a result, a pronounced difference in absorbance also occurs between 2924 $cm^{-1}$ and 2854 $cm^{-1}$. As described above, when a DLC film is not present, the lubricating oil deteriorates due to wear particles from the bottom pivot 173B and bearing unit 16 that become dispersed in the lubricating oil, lubrication performance therefore drops, and lubricating oil life becomes shorter.

Therefore, in order to obtain stable lubrication performance without the lubricating oil deteriorating over a long period of time, suppressing wear of the base metal of the staff 17 and the bearing unit 16 is important. Wear of the base metal of the staff 17 is prevented in this embodiment of the invention by forming a DLC film on the staff 17 (bottom pivot 173B).

Figure 11:
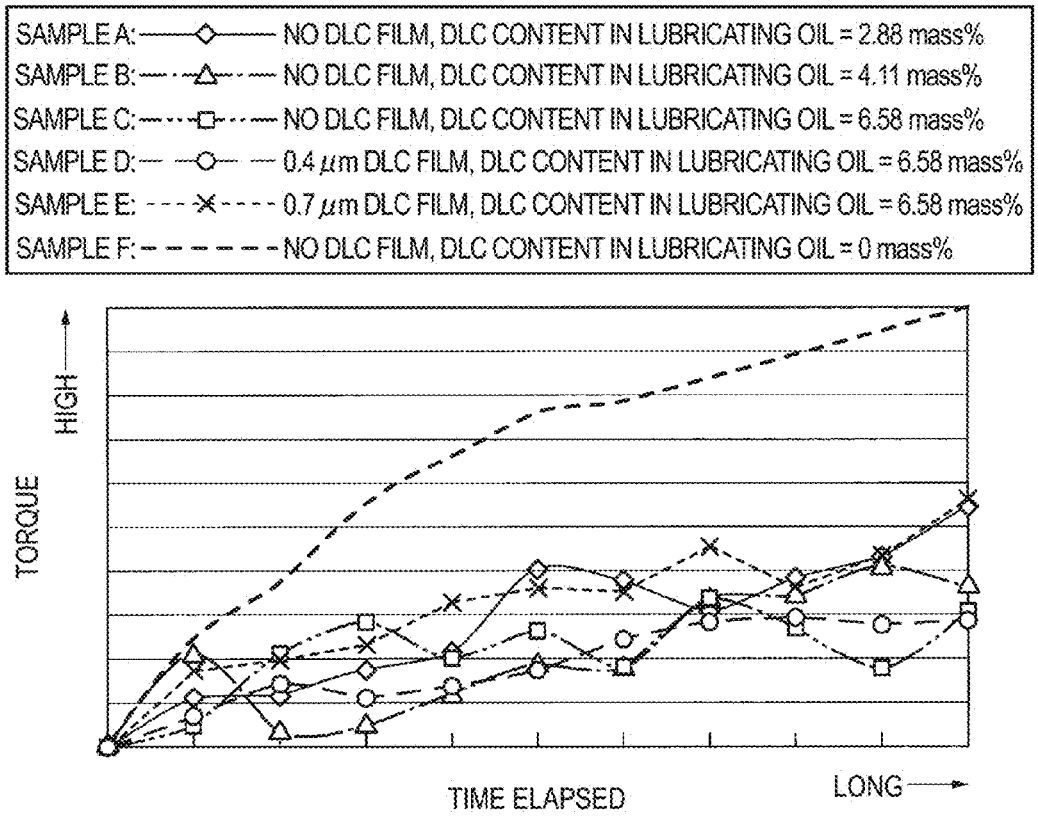
FIG. 11 shows the results of a timepiece durability test of a bearing configuration in which a DLC film is not formed and a lubricating oil containing DLC powder is used, a bearing configuration in which a DLC film is formed and a lubricating oil containing DLC powder is used, and a bearing configuration in which a DLC film is not formed and the lubricating oil does not contain DLC powder.

FIG. 11 shows the results of a timepiece durability test using a bearing structure that does not have a DLC film formed thereon but has DLC powder in the lubricating oil, a bearing structure that has a DLC film formed thereon and DLC powder in the lubricating oil, and a bearing structure that does not have a DLC film formed thereon and DLC powder is not in the lubricating oil. Note that the elapsed time of this durability test shown on the x-axis in FIG. 11 is longer than the elapsed time of the durability test for which results are shown in FIG. 9.

As shown in FIG. 11, 0.5 μm of wear was confirmed in the base metal (carbon steel with Ni plating) of the staff 17 in the samples A, B, C that did not have a DLC film formed on the staff 17 but had DLC powder in the lubricating oil. When DLC powder is contained in the lubricating oil, the DLC powder in the lubricating oil can suppress an increase in torque as described above with reference to FIG. 9, but if the base metal (carbon steel and Ni plate) of the staff 17 wears, wear particles from the base become dispersed in the lubricating oil, and the lubricating oil deteriorates as shown in FIG. 10.

In contrast, 0.2 μm of wear in the DLC film was confirmed and wear of the base metal of the staff 17 was not observed in the samples D and E that had a DLC film formed on the staff 17. Deterioration of the lubricating oil is suppressed with these samples D and E as shown in FIG. 10 because wear particles from the base metal of the staff 17 are not dispersed in the lubricating oil. In addition, because DLC powder is dispersed as a powder in the lubricating oil, an increase in torque can be effectively suppressed. It should be noted that the DLC powder content in the lubricating oil after wear of the DLC film on the staff 17 was 8.22 mass %, but a resulting increase in torque was not observed, and the DLC powder dispersed in the lubricating oil was shown to act as a lubricating agent.

It was thus confirmed that an effective lubrication effect can be achieved by rendering a DLC film on the staff 17 and using a lubricating oil containing a DLC powder dispersion, that wear of the base metal can be prevented and deterioration of the lubricating oil can be prevented by means of a DLC film, a bearing structure with a long service life can be achieved, and a torque reduction effect can be achieved over the long term.

Furthermore, putting lubricating oil between the staff 17 and the bearing unit 16 also has the benefit of preventing the DLC powder that is produced by friction between the staff 17 and bearing unit 16 from spreading. That is, when lubricating oil is not present, the DLC powder may be spread onto other parts of the timepiece wheel train 100A and electronic circuit parts, thus affecting timepiece 100 operation by, for example, accumulating in places and causing such problems as adding resistance to the movement of the wheel train and reducing the precision of the timepiece movement.

However, by using lubricating oil between the staff 17 and bearing unit 16 as in this embodiment of the invention, the DLC powder is prevented from spreading, and has no adverse affect on driving other parts of the timepiece 100 or the circuits.

A DLC film as described above is formed on the surface of the third wheel 3 to a thickness of 0.8 μm to 2.0 μm, and further preferably to a film thickness of approximately 1 μm.

This DLC film is formed by ion plating. When a film is formed by ion plating, the deposition of particulate with a large particle diameter, such as coarse particles, increases as the film deposition time increases. Deposition of coarse particles, for example, may therefore increase when the DLC film is formed to a film thickness of 2.0 μm or greater because the DLC film deposition time increases. When such coarse particles are numerous on the surface of the target component, particles separate due to rotation of the shaft member and become dispersed into the lubricating oil, and it becomes difficult to effectively reduce sliding friction resistance.

Figure 12A:
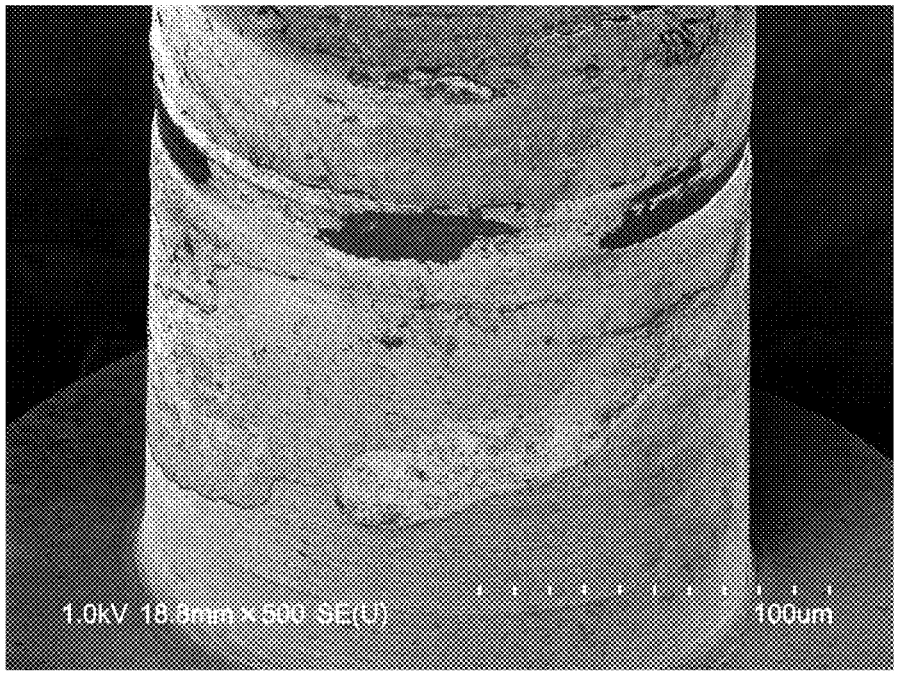
FIGS. 12A and 12B are respective photographs of a third wheel on which a DLC film is formed to a film thickness of 0.35 μm, and a third wheel on which a DLC film is formed to a film thickness of 0.8 μm, after a durability test.
Figure 12B:
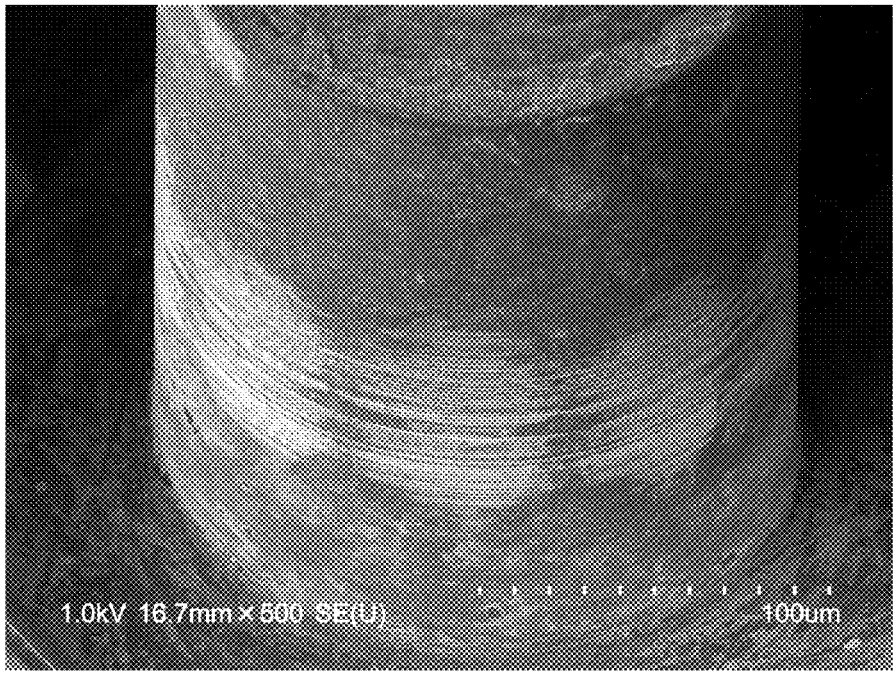
Figure 13:
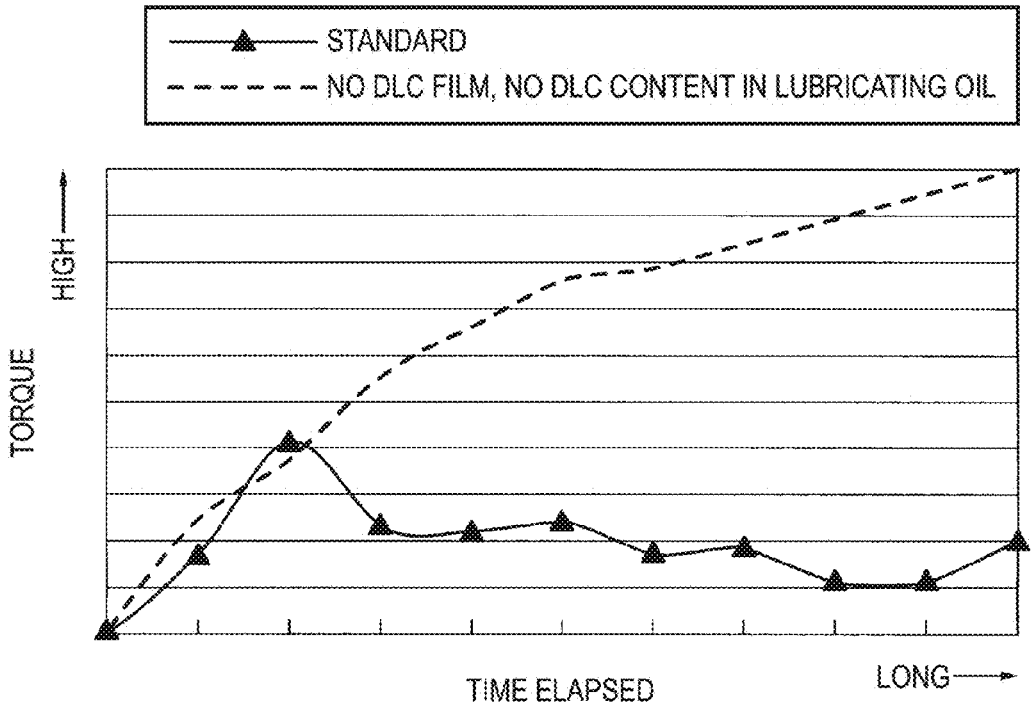
FIG. 13 shows the results of a timepiece durability test of the third wheel when a 1 μm thick DLC film is formed thereon and numerous coarse particles have been produced.

Photographs taken after the durability test of a third wheel 3 having a 0.35 μm thick DLC film and a third wheel 3 having a 0.8 μm thick DLC film formed thereon are shown in FIG. 12. FIG. 13 shows the results of a timepiece durability test when a 1 μm thick DLC film was formed on the third wheel 3 and there were numerous coarse particles. Note that FIG. 13 shows the results of testing a sample on which the DLC film was formed with a deposition time sufficiently longer than the deposition time normally used to form a 1 μm thick DLC film so that the DLC film would separate easily.

As shown in FIG. 13, when the DLC film deposition time increases, coarse particles are easily produced even though the film thickness is approximately 1 μm. When such particles occur, there is a temporary rise in the torque required to turn the third wheel 3 as shown in FIG. 13. When the DLC film thickness is 2 μm or greater, the DLC film deposition time increases according to the film thickness, and the likelihood of large diameter particle deposits occurring as described above is even higher. The DLC film thickness in the invention is therefore preferably less than 2.0 μm, a thickness can be achieved without the deposition time becoming too long and can reduce the likelihood of large diameter particles being formed.

It should be noted that a drop in torque over time has been confirmed as shown in FIG. 13 even when such particles are formed, and the change in torque thereafter is substantially the same as that of a DLC film that is formed with a short deposition time and is resistant to separation. This is because when such large particles are formed, the particles are gradually worn down over time to smaller particles of 100 nm or less, and because the composition of these particles is the same as that of the DLC film, the particles work as a lubricating agent as a result of breaking down.

However, when the film thickness is 0.5 μm or less, separation of the DLC film frequently occurs due to sliding against the bearing unit 16. Because particles larger than the DLC powder are dispersed into the lubricating oil when this type of DLC film separates, there may be an increase in sliding friction resistance. In addition, even if the DLC film does not separate, the DLC film wears down as shown in FIG. 12 and the base layer of the bottom pivot 173B may be exposed. While the DLC powder that is dispersed into the lubricating oil when this occurs has a certain lubrication effect, the bottom pivot 173B becomes exposed. When this happens and the bottom pivot 173B wears, the resulting wear particles can cause the lubricating oil to deteriorate.

As a result, the DLC film is preferably formed to a thickness of approximately 0.8 μm to 2.0 μm. By thus forming the DLC film to a thickness of 0.8 μm to 2.0 μm, the DLC film can be prevented from wearing out, separation particles can be prevented, and a good lubrication effect can be maintained. In addition, when wear particles are produced by sliding against the bearing unit 16, the diameter of the DLC wear particles will be 100 nm or less as described above, and the wear particles will be dispersed into the lubricating oil as a good lubricating agent. Furthermore, because the wear particles do not exfoliate as fragments, sliding friction resistance between the staff 17 and bearing unit 16 can be effectively reduced.

A method of forming the DLC film is described in further detail next. To form the DLC film, this embodiment of the invention uses a hydrogen-free PVD (physical vapor deposition) method such as ion plating using a hydrogen-free material such as graphite in an atmosphere that does not contain hydrogen (a hydrogen-free atmosphere). This hydrogen-free PVD method can form a DLC film with high hardness and excellent adhesion on precision parts such as a staff 17 and other shaft units of the timepiece wheel train 100A in this embodiment of the invention, and can prevent DLC film separation and excessive wear of the DLC film when the staff 17 and bearing unit 16 slide against each other.

When a film is formed on the even smaller shaft parts of precision components such as timepiece components, the film properties of the shaft part and the reference sample differ under the same conditions, and the desired hardness and adhesion cannot be assured. More specifically, a DLC film formed by a hydrogen-free PVD method as described above can prevent the exfoliation and wear that would expose the surface of the base layer of the staff 17, and can produce DLC powder of an amount suitable to prevent exposing the base layer of the staff 17.

Furthermore, because the resulting DLC powder is dispersed in the lubricating oil, the sliding friction resistance of the staff 17 and bearing unit 16 is further reduced, and separation and wear of the DLC film can be further suppressed.

In addition, a fluoroplastic coating formed over the entire third wheel 3 renders an oil and DLC powder retention layer over the DLC film. Lubricating oil is placed between the pivots 173A and 173B of the third wheel 3 and the bearing units 16, and this oil and DLC powder retention layer functions to prevent the lubricating oil from spreading and hold the lubricating oil between the pivots 173A and 173B and the bearing units 16. In addition, when the DLC film separates as a result of the staff 17 and bearing unit 16 sliding together, the fluoroplastic on the exfoliated surface is refreshed by the oil and DLC powder retention layer formed by this fluoroplastic coating. The lubricating oil is therefore not spread by exfoliation of the DLC film, and the lubricating oil can be held in place for a long time. This oil and DLC powder retention layer is formed by dipping the third wheel 3 in a mixture of a stock solution having a high performance fluorinated homopolymer synthesized with a completely fluorinated inert solution, and a dilute solution that does not dissolve water and has desirable solubility in the inert fluorinated solution, and then drying.

The differences in the properties, particularly adhesion and hardness, of the DLC film resulting from the method of forming the DLC film on the bottom pivot 173B of the third wheel 3 in the timepiece wheel train 100A described above are described next with reference to the figures. More particularly, the DLC film is formed by a hydrogen-free PVD method in this embodiment of the invention as described above, and the characteristics of a DLC film formed by this hydrogen-free PVD method and the characteristics of a DLC film formed by a plasma CVD method are described next.

Figure 14:
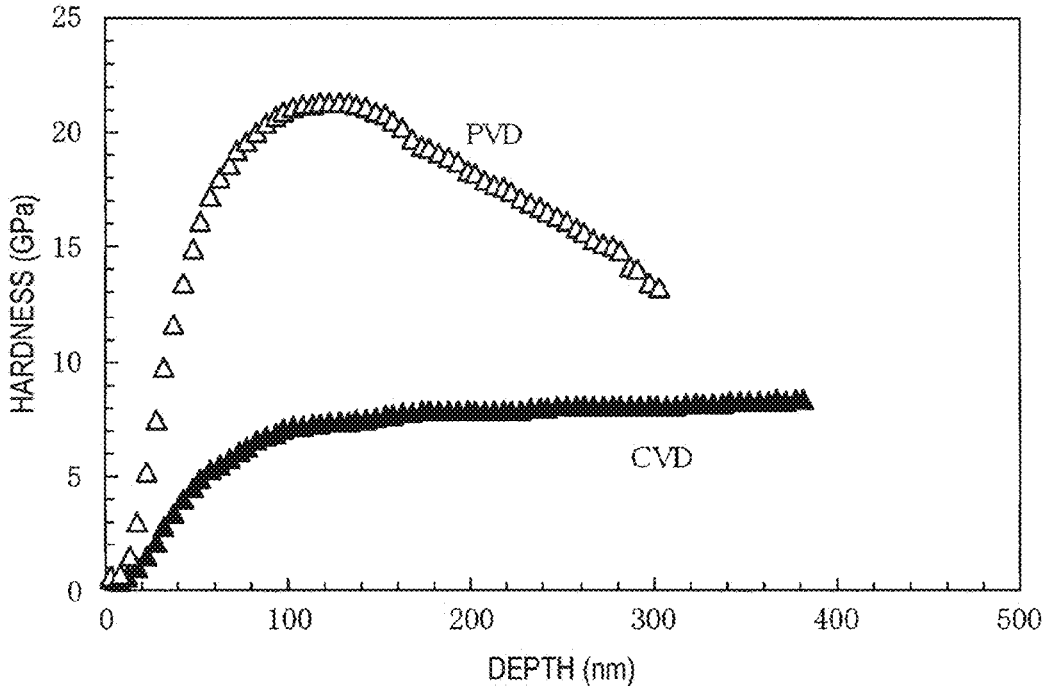
FIG. 14 shows the results of an indentation test of a DLC film formed by a hydrogen-free PVD method and a DLC film formed by a plasma CVD method.
Figure 15:
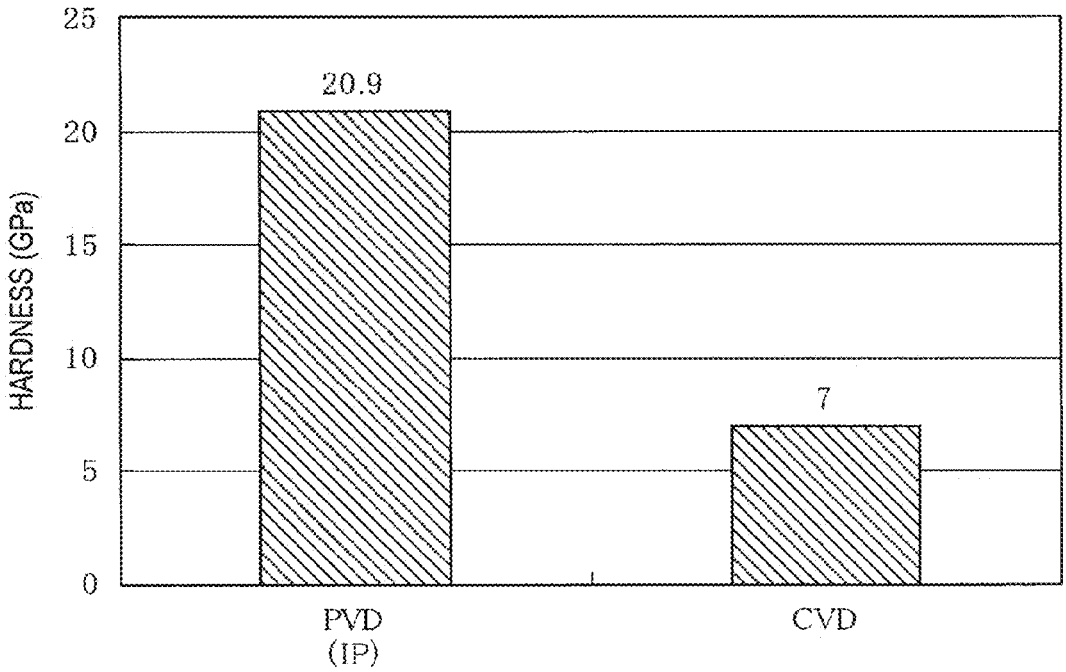
FIG. 15 compares the hardness of a DLC film formed by a hydrogen-free PVD method and a DLC film formed by a plasma CVD method.
Figure 16:
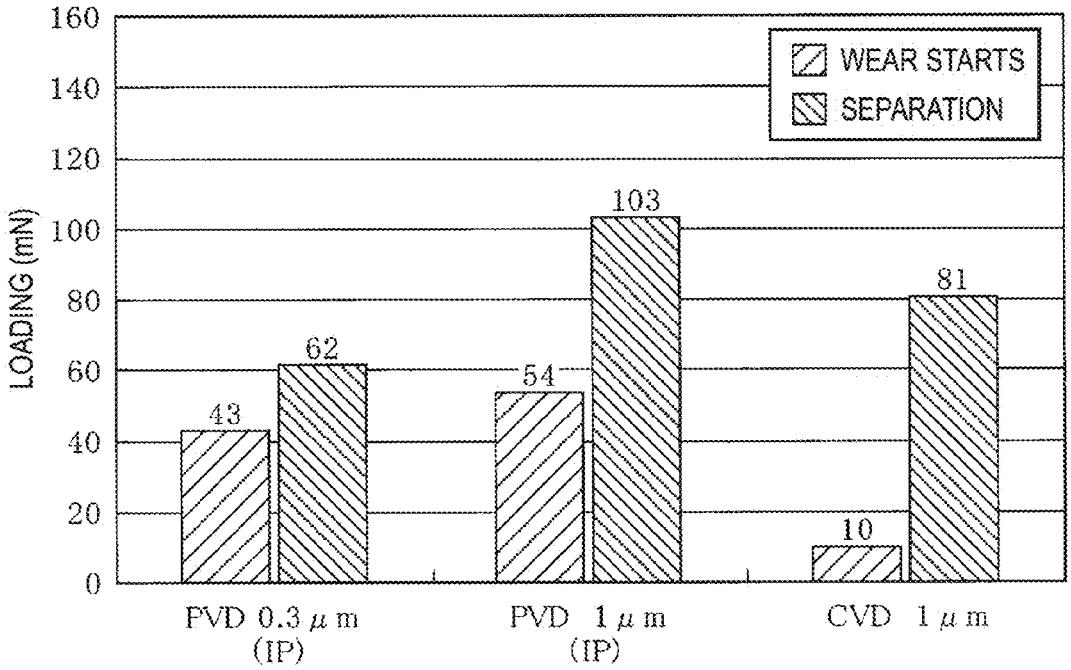
FIG. 16 compares adhesion with a DLC film formed by a hydrogen-free PVD method and a DLC film formed by a plasma CVD method.

FIG. 14 shows the pressure required to produce a particular indentation depth in a DLC film formed by a hydrogen-free PVD method on the shaft of a timepiece component according to this embodiment of the invention, and in a DLC film formed by plasma CVD. FIG. 15 compares the hardness of a DLC film formed by a hydrogen-free PVD method according to this embodiment of the invention, and a DLC film formed by plasma CVD. FIG. 16 compares the adhesion of a DLC film formed by a hydrogen-free PVD method according to this embodiment of the invention, and a DLC film formed by plasma CVD.

As shown in FIG. 14, the results of an indentation test confirmed that while the hardness of the DLC film formed by plasma CVD is lower than that of the reference sample, the DLC film formed by hydrogen-free PVD exhibits high hardness comparable to the reference sample at all indentation depths.

As shown in FIG. 15, the hardness per unit area of the DLC film formed by hydrogen-free PVD was confirmed to be high at 20 GPa, and is much higher than the hardness of a DLC film formed by plasma CVD on the shaft of a timepiece component.

As shown in FIG. 16, the DLC film formed by plasma CVD starts to wear when a vertical load is applied in a 10 mN scratch test, and starts to separate when a 81 mN vertical load is applied. In contrast, the DLC film formed by hydrogen-free PVD starts to wear with a vertical load of 54 mN, and starts to separate with a vertical load of 103 mN. More specifically, the DLC film formed by hydrogen-free PVD was confirmed to have good adhesion to the staff 17. It was also confirmed that the vertical load at which separation occurs is lower with a DLC film thickness of 0.3 μm than a film thickness of 1.0 μm, and wear and separation occur with a low frictional force. As described above, sliding friction resistance between the bottom pivot 173B and the bearing unit 16 can be reduced and an increase in torque with age can be prevented even when the thickness of the DLC film is less than or equal to 0.5 μm, but the base layer of the bottom pivot 173B is preferably not exposed in order to prevent deterioration of the lubricating oil. Therefore, in order to prevent exposing the base layer of the bottom pivot 173B as a result of wear and separation of the DLC film, the film thickness of the DLC film is preferably 0.8 μm or greater.

Effect of this Embodiment

As described above, a lubricating oil containing a DLC powder dispersion is between the staff 17 and the bearing unit 16 at the bottom pivot 173B of the third wheel 3 in the timepiece wheel train 100A of a timepiece 100 according to this embodiment of the invention. DLC has low resistance and can further reduce sliding friction resistance between the staff 17 and the bearing unit 16 when dispersed in lubricating oil as a powder because the powder acts as a lubricating agent. This DLC powder therefore becomes uniformly distributed throughout the sliding area of the staff 17 and bearing unit 16, and can reduce sliding friction resistance. The timepiece wheel train 100A can therefore transmit drive power to the hands with good precision for a long time, can maintain high precision in the timepiece 100 movement for a long time, and can increase the life of the timepiece. In addition, because the torque needed to rotate the third wheel 3 where side pressure is greatest can be kept low, the load on the motor that is the drive power source can also be reduced, and energy efficiency can be improved.

As also described above, a DLC film is formed on the bottom pivot 173B of the third wheel 3.

As a result, the sliding resistance between the staff 17 and bearing unit 16 can be further reduced by this DLC film. In addition, when DLC powder is produced by rotation of the staff 17, the wear particles are dispersed into the lubricating oil, and as described above the wear particles can work as a lubricating agent. Therefore, sliding friction resistance can be initially reduced by the combined effect of the DLC film and the lubricating oil when the timepiece is first used, and after a number of years have passed, the sliding friction resistance can be reduced by the combined effect of the DLC film, the lubricating oil, and the DLC powder that is dispersed into the lubricating oil. The staff 17 can therefore be protected for a long period of time by the DLC film, and sliding friction can be kept low. As a result, the timepiece wheel train 100A can transmit drive power to the hands with good precision for a long time, high precision can be maintained in the timepiece 100 movement for a long time, and the life of the timepiece can be increased.

Yet further, because a DLC film is formed on the staff 17, wear of the base metal of the staff 17 can be prevented when the staff 17 is driven rotationally. Wear particles from the base metal of the staff 17 can therefore be prevented from being spread and deterioration of the lubricating oil can be prevented. A drop in the lubrication efficiency of the lubricating oil can thus be prevented, and the life of the lubricating oil can be increased.

As also described above, the DLC film formed on the third wheel 3 is made using a hydrogen-free PVD process.

As a result, a DLC film with strong adhesion and high hardness can be stably formed to a film thickness of approximately 0.8 μm to 2.0 μm on the wheels and pinions of a wristwatch, including such minute parts as the bottom pivot 173B with a diameter of approximately 0.18 mm.

Furthermore, by forming a hydrogen-free DLC film using a hydrogen-free PVD method, a higher ratio of spa bonds to $sp^2$ bonds can be achieved in the crystalline structure of the DLC film, and a DLC film with greater hardness can be formed. Yet further, a hydrogen-free DLC film can further reduce sliding friction resistance, works well with the lubricating oil, and DLC powder resulting therefrom can be efficiently dispersed into the lubricating oil.

The DLC film is formed to a film thickness of 0.8 μm to 2.0 μm. This enables preventing exposure of the base layer of the bottom pivot 173B due to the DLC film wearing down or exfoliating, and can prevent deterioration of the lubricating oil. Yet further, the DLC film can be more easily formed to a uniform film thickness, and the DLC film can be formed with a precise film thickness, by using a hydrogen-free PVD method.

More specifically, sliding friction resistance can be reduced and a torque reduction effect can be achieved over the long term even when the film thickness of the DLC film is less than or equal to 0.5 μm. However, the bottom pivot 173B may be exposed as a result of the DLC film wearing out or exfoliating, and the lubricating oil may be damaged as a result of this wear. Furthermore, when the DLC film thickness is greater than or equal to 2.0 μm, sliding friction resistance between the bottom pivot 173B and bearing unit 16 can be reduced and a torque reduction effect can be achieved over the long term by maintaining suitable DLC film hardness and adhesion. However, when the film is formed using a hydrogen-free PVD method, the risk of coarse particles and other surface particulate forming increases, the film formation processes and film deposition time become longer, and it becomes more difficult to form a film with a precise, uniform thickness.

However, when the DLC film is formed to a film thickness from 0.8 μm to 2.0 μm, the risk of coarse particles and other surface deposits being formed can be minimized by using a hydrogen-free PVD method, and a DLC film with uniform film thickness and suitable hardness and adhesive strength can be easily formed. Furthermore, as shown in FIG. 12, because the DLC film can be prevented from wearing out and the base layer of the bottom pivot 173B is not exposed, deterioration of the lubricating oil as a result of bottom pivot 173B wear can also be prevented.

The particle diameter of the DLC powder is less than or equal to 100 nm at this time. As a result, the DLC powder does not create resistance to rotation and can work as a lubricating agent, and the combined effect of the DLC film, lubricating oil, and DLC powder can more effectively reduce sliding friction resistance.

In addition, ruby or other similar material with high hardness that is less than or equal to the hardness of the DLC film is used to make the bearing unit 16 that supports the staff 17 on which a DLC film is formed. In the foregoing embodiment, for example, the hardness of the DLC film is 20 GPa or more, and the bearing unit 16 is made of ruby, which is a material with high hardness, having a hardness of 15 GPa.

As a result, damage to the DLC film by a bearing unit 16 made of ruby can be suppressed, and excessive wear of the DLC film can be prevented. In addition, because the DLC film has low resistance, the DLC film does not act aggressively towards the bearing unit 16 even when the DLC film has greater hardness than the bearing unit 16, and damage to the bearing unit 16 can also be suppressed. As described above, damage resulting from the sliding friction of the staff 17 and bearing unit 16 can be suppressed, good precision can be maintained in the timepiece 100 movement, and timepiece life can be increased.

As also described above, the bottom pivot 173B (staff 17) is made from a carbon steel base metal with Ni plating, a Ti layer is formed over the Ni plating, and the DLC film is formed over this Ti layer. By thus forming the DLC film on an intervening Ti layer, the stress difference between the DLC film and the base material can be absorbed by the Ti layer, and DLC film adhesion can be increased. When friction occurs between the DLC film and the bearing unit 16, the particle diameter of the resulting DLC wear particles can be kept to 100 nm or less. Therefore, when DLC wear particles are produced by friction between the DLC film and the bearing unit 16, the wear particles can be dispersed in the lubricating oil and an improved lubrication effect can be achieved.

A fluorinated coating that is an oil and DLC powder retention layer is also applied to the staff 17 and bearing unit 16.

As a result, the lubricating oil is held between the staff 17 and bearing unit 16 by the fluorinated coating. More specifically, the oil and DLC powder retention layer prevents such problems as the lubricating oil being dispersed onto other parts, can keep the lubricating oil between the staff 17 and bearing unit 16 for a long time, and can effectively reduce the sliding friction resistance between the staff 17 and bearing unit 16. As a result, the precision of the timepiece 100 can be maintained for a long time, and the life of the timepiece 100 can be extended.

Furthermore, because the oil and DLC powder retention layer is a fluoroplastic coating, the fluoroplastic extends to the exfoliated surface if the DLC film of the staff 17 separates due to sliding friction, and a renewed fluoroplastic coating can be formed on the exfoliated surface.

Variations of the Invention

It will be obvious to one with ordinary skill in the related art that the invention is not limited to the foregoing embodiment and includes other configurations and variations that can achieve the same object. Examples of such variations are described below.

For example, the DLC film is formed in the foregoing embodiment on the bottom pivot 173B of the third wheel 3 where side pressure is greatest, but the invention is not so limited. More particularly, configurations in which the DLC film is formed over the entirety of the wheels and pinions 2 to 6, or only on the pivots 173A and 173B of the wheels and pinions 2 to 6, are also conceivable. Because such configurations can reduce frictional resistance on the pinions 171 and wheels 170 as well as between the pivots 173A and 173B and the bearing units 16, the minimum torque required to drive the movement can be reduced, the precision of the timepiece 100 movement can be improved, and timepiece life can be increased.

Furthermore, the DLC film is formed on the staff 17 in the foregoing embodiment, but a configuration in which the DLC film is formed on the bearing unit 16 is also conceivable. A configuration in which the DLC film is formed on both the bearing unit 16 and the staff 17 is also conceivable.

A timepiece with a generator function that automatically winds the mainspring is described as an example of a timepiece 100 according to the invention, but the invention can obviously be used with other types of mechanical timepieces. More particularly, the invention may also be applied to a timepiece wherein the timepiece wheel train of the invention is rendered by wheels in the wheel train of a mechanical timepiece that has a mainspring as a mechanical energy source; a wheel train including a center wheel that meshes with a movement barrel containing the mainspring; a regulator mechanism that includes an escape wheel and pinion, pallet fork, and balance and hairspring, and regularly releases the mechanical energy stored in the mainspring; and hands connected to the wheel train. In such a timepiece, the wheel train of the invention includes the center wheel to which at least the minute hand is attached, a third wheel to which rotation is transmitted from the center wheel, and a fourth wheel that is disposed to the center wheel staff, has rotation transmitted thereto from the third wheel, and has the second hand attached thereto.

The invention is also not limited to a timepiece that drives the movement by means of a mainspring. More particularly, the invention can also be applied to timepieces that operate using drive power from a stepping motor, for example. Timepiece life can also be increased and the precision of the timepiece movement can be improved in such timepieces by forming a DLC film on the pivots of the wheels and pinions.

The specific constructions and steps used to achieve the invention can also be suitably changed within the scope of being able to achieve the object of the invention.

Although the present invention has been described in connection with the preferred embodiments thereof with reference to the accompanying drawings, various changes and modifications will be apparent to those skilled in the art in light of such disclosure. Any such change or modification is to be understood as included within the scope of the present invention to the extent it falls within any of the claims of this application.

What is claimed is:

1. A timepiece wheel train, comprising:

a rotating body with a shaft unit;

a bearing unit that rotatably supports the shaft unit of the rotating body; and a lubricating oil in which powder from a diamond-like carbon film is dispersed disposed between the shaft unit and the bearing unit; and a fluoroplastic coating formed on at least one of the shaft unit and bearing unit, the fluoroplastic coating forming an oil and diamond-like carbon powder retention layer that suppresses spreading of the lubricating oil and retains powder from the diamond-like carbon film.

2. The timepiece wheel train described in claim 1, wherein:

a diamond-like carbon film is formed on at least one of the shaft unit and the bearing unit; and the powder of the diamond-like carbon film dispersed in the lubricating oil consists of wear particles of the diamond-like carbon film that are produced when the diamond-like carbon film formed on at least one of the shaft unit and the bearing unit wears during rotation of the shaft unit.

3. The timepiece wheel train described in claim 1, wherein:

a diamond-like carbon film is formed on either the shaft unit or the bearing unit; and the other of the shaft unit or bearing unit on which the diamond-like carbon film is not formed is made from a hard material with lower hardness than the diamond-like carbon film.

4. The timepiece wheel train described in claim 1, wherein:

a hydrogen-free atmosphere physical vapor deposition formed diamond-like carbon film is formed on at least one of the shaft unit and the bearing unit.

5. The timepiece wheel train described in claim 4, wherein:

the particle diameter of powder from the diamond-like carbon film is less than or equal to 100 nm.

6. The timepiece wheel train described in claim 4 wherein:

the diamond-like carbon film has a thickness of 0.8 μm to 2.0 μm.

7. The timepiece wheel train described in claim 4 wherein:

the diamond-like carbon film has a hardness of 20 GPa to 40 GPa.

* * * * *